US010831142B2

(12) United States Patent
Akasaka

(10) Patent No.: US 10,831,142 B2
(45) Date of Patent: Nov. 10, 2020

(54) IMAGE FORMING APPARATUS THAT CONTROLS CHARGE UNIT

(71) Applicant: CANON KABUSHIKI KAISHA, Tokyo (JP)

(72) Inventor: Eiji Akasaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,772

(22) Filed: Jul. 30, 2019

(65) Prior Publication Data

US 2020/0041945 A1 Feb. 6, 2020

(30) Foreign Application Priority Data

Aug. 6, 2018 (JP) ..... 2018-147445

(51) Int. Cl.
*G03G 15/00* (2006.01)
*G03G 15/02* (2006.01)
*G03G 15/16* (2006.01)

(52) U.S. Cl.
CPC ..... *G03G 15/556* (2013.01); *G03G 15/0225* (2013.01); *G03G 15/161* (2013.01)

(58) Field of Classification Search
CPC . G03G 15/556; G03G 15/0225; G03G 15/161
See application file for complete search history.

(56) References Cited

U.S. PATENT DOCUMENTS 5,384,623 A * 1/1995 Ohashi ..... G03G 15/0258 399/100
2005/0078981 A1 4/2005 Ishiyama
2014/0340457 A1 11/2014 Hashimoto
2017/0115622 A1* 4/2017 Okayasu ..... G03G 21/00

FOREIGN PATENT DOCUMENTS

JP 2004-126202 A 4/2004
JP 2010-072089 A 4/2010
JP 2011-017817 A 1/2011
JP 2014-224844 A 12/2014
JP 2015-011159 A 1/2015

* cited by examiner

*Primary Examiner* — Clayton E. LaBelle
*Assistant Examiner* — Michael A Harrison
(74) *Attorney, Agent, or Firm* — Canon U.S.A., Inc. IP Division

(57) ABSTRACT

The pixels counting unit divides an area in a main-scanning direction of a recording material on which image formation is performed into a plurality of areas 1 to n based on a width that is a length in the main-scanning direction of the recording material, and measures a pixels count with respect to each area among the plurality of areas 1 to n defined by dividing the area in the main-scanning direction of the recording material.

22 Claims, 10 Drawing Sheets

IMAGE FORMING APPARATUS THAT CONTROLS CHARGE UNIT

BACKGROUND

Field of the Disclosure

The present disclosure relates to an image forming apparatus such as a printing apparatus, particularly a copier, a laser beam printer and a facsimile machine.

Description of the Related Art

As image forming apparatuses that use an electrophotographic process, image forming apparatuses are already known that have an intermediate transfer member. In recent years, there is a demand to reduce the size of image forming apparatuses. Therefore, there are some image forming apparatuses which have a configuration in which a cleaning unit of a photosensitive drum that recovers toner that remains on the photosensitive drum after a toner image has been transferred from the photosensitive drum to an intermediate transfer belt is not provided. Hereunder, such a configuration is referred to as a "photosensitive drum cleaner-less configuration". In a photosensitive drum cleaner-less configuration, toner adhering to a photosensitive drum after a toner image was transferred, more specifically, toner charged to the reverse polarity, may sometimes adhere to a charge roller that is disposed in contact with the photosensitive drum. If toner adheres to the charge roller, the capacity of the charge roller to charge the photosensitive drum changes, and hence the latent image potential of a portion corresponding to a position at which toner adheres changes. In particular, if toner adheres to only one part in the axial direction of the charge roller, the latent image potential difference will be large at the boundary of that one part, and if a uniform image in the axial direction of the photosensitive drum is printed in that state, image density unevenness that is referred to as a "ghost image" will occur. As one example, a case will be assumed in which a half-tone image or a solid image is printed immediately after consecutively printing images including ruled lines or the like at the same position in the axial direction of the photosensitive drum surface. In this case, it becomes easy to visually recognize a ghost image at a place where there were ruled lines during the previous printing operation. In particular, the occurrence of ghost images becomes a problem for a user who prints a large quantity of such images in a single job.

For example, Japanese Patent Application Laid-Open No. 2004-126202 discloses a configuration in which, to prevent ghost images, an operation for cleaning a charge roller is performed at a time of non-image formation. Specifically, first, toner adhering to a charge roller is moved to a photosensitive drum by making the polarity of a voltage applied to the charge roller the reverse polarity to the polarity of a voltage applied at a time of image formation. Hereunder, the movement of toner adhering to a charge roller to a photosensitive drum is also described as "ejecting toner from a charge roller to a photosensitive drum". Thereafter, the polarity of a voltage applied to a transfer unit provided at a position facing the photosensitive drum across an intermediate transfer belt is made the reverse polarity to the polarity at a time of image formation. By this means, toner that was expelled to the photosensitive drum transfers to the intermediate transfer belt and is recovered by a cleaning unit of the intermediate transfer belt provided at the intermediate transfer belt.

The following methods have been disclosed as methods for determining the timing for performing a charge roller cleaning operation. For example, in Japanese Patent Application Laid-Open No. 2004-126202, a configuration is disclosed that includes a number of printed sheets summing unit configured to sum the number of printed sheets, and in which a charge roller cleaning operation is executed based on a predetermined summed number of printed sheets. Further, for example, in Japanese Patent Application Laid-Open No. 2011-017817, a configuration is disclosed that includes a unit that counts a pixels count in respective areas that are defined when an area on a photosensitive drum is divided into a plurality of areas in the axial direction, in which a charge roller cleaning operation is performed in a case where a pixels count in any area is equal to or greater than a predetermined number. Thus, a charge roller cleaning operation can be executed at an optimal timing by determining the timing for executing the charge roller cleaning operation according to the pixels count of each area, and a decrease in throughput that is caused by charge roller cleaning operations is suppressed.

In the aforementioned unit that counts a pixels count, the smaller that the width of the respective areas defined when an area on a photosensitive drum is divided into a plurality of areas in the axial direction is, the more accurately the accumulated amount of toner in the axial direction on the charge roller can be predicted. However, the smaller that the width of the respective areas is made, the greater the processing speed and memory capacity that are required to count the pixels count for each area, which leads to an increase in costs. There are sometimes cases in which, as the result of suppressing an increase in costs, the width of each area in which a pixels count is to be counted becomes greater than the width of a visually observable ghost image. A problem in such a case is that an error sometimes occurs with respect to the correlation between the count of the pixels counts for the respective areas and the accumulated amount of toner in the axial direction on the charge roller, and consequently a charge roller cleaning operation is performed earlier than the actual optimal timing during a print job. In other words, a decrease in throughput occurs because the width of each area in which the pixels count is counted became large. Therefore, there is a need to suppress a decrease in throughput that is caused by a cleaning operation for a charge roller, even in a case where there is a limitation on the width of each area in which a pixels count is counted.

SUMMARY

An aspect of some embodiments is an image forming apparatus that, even in a case where, in order to suppress an increase in costs, there is a limitation on a width of each area in which a pixels count is counted, suppresses a decrease in throughput that is caused by a cleaning operation on a charge roller.

Another aspect of some embodiments is an image forming apparatus for performing image formation on a recording material, the image forming apparatus including: a photosensitive member configured to rotate in a predetermined rotation direction, a charge unit configured to charge a surface of the photosensitive member to a predetermined potential, an exposure unit including a light source configured to emit a light beam according to image data, the exposure unit configured to form a latent image on the photosensitive member by scanning the light beam in a scanning direction substantially orthogonal to the rotation direction, a developing unit configured to develop the latent image formed by the exposure unit by toner to form a toner image, an intermediate transfer member onto which the toner image formed on the photosensitive member by the developing unit is to be transferred, a transfer unit configured to transfer the toner image onto the intermediate transfer member, a measuring unit configured to measure a pixels count of pixels forming the toner image based on the image data, a prediction unit configured to predict an amount of toner adhering to the charge unit, based on the pixels count measured by the measuring unit, and a determination unit configured to make a determination as to whether or not to perform a removing process that removes toner from the charge unit, based on the amount of toner predicted by the prediction unit, wherein based on a width that is a length in the scanning direction of a recording material on which the image formation is performed, the measuring unit divides an area in the scanning direction of the recording material into a plurality of areas, and measures the pixels count for each area of the plurality of areas into which the area in the scanning direction of the recording material is divided.

A further aspect of some embodiments is an image forming apparatus configured to perform image formation on a recording material, including a photosensitive member configured to rotate in a predetermined rotation direction, a charge unit configured to charge a surface of the photosensitive member to a predetermined potential, an exposure unit including a light source configured to emit a light beam according to image data, the exposure unit being configured to form a latent image on the photosensitive member by scanning the light beam in a scanning direction substantially orthogonal to the rotation direction, a developing unit configured to develop the latent image formed by the exposure unit by toner to form a toner image, an intermediate transfer member onto which the toner image formed on the photosensitive member by the developing unit is to be transferred, a measuring unit configured to measure a pixels count of pixels forming the toner image based on the image data, a prediction unit configured to predict an amount of toner adhering to the charge unit, based on the pixels count measured by the measuring unit, and a determination unit configured to make a determination as to whether or not to perform a removing process that removes toner from the charge unit, based on the amount of toner predicted by the prediction unit, wherein based on a width that is a length in the scanning direction of an image to be formed on a recording material on which image formation is performed, the measuring unit divides an area in the scanning direction of the image into a plurality of areas, and measures the pixels count for each area of the plurality of areas into which the area in the scanning direction of the image is divided.

Further features of various embodiments will become apparent from the following description of exemplary embodiments with reference to the attached drawings.

DESCRIPTION OF THE EMBODIMENTS

Exemplary embodiments will now be described in detail in accordance with the accompanying drawings.

Hereunder, these embodiments are described in detail while referring to the accompanying drawings. Note that the aforementioned expression "expel toner from a charge roller to a photosensitive drum" is also used in the following description.

Embodiment 1

In Embodiment 1, a method will be described in which, when making a determination as to whether to perform a charge roller cleaning operation according to a measured pixels count (a counted pixels count), the width of an area in which a pixels count is to be counted is changed according to the width of the recording material. Hereunder, counting a pixels count is referred to as "measure a pixels count".

(Description of Configuration of Image Forming Apparatus)

Figure 1A:
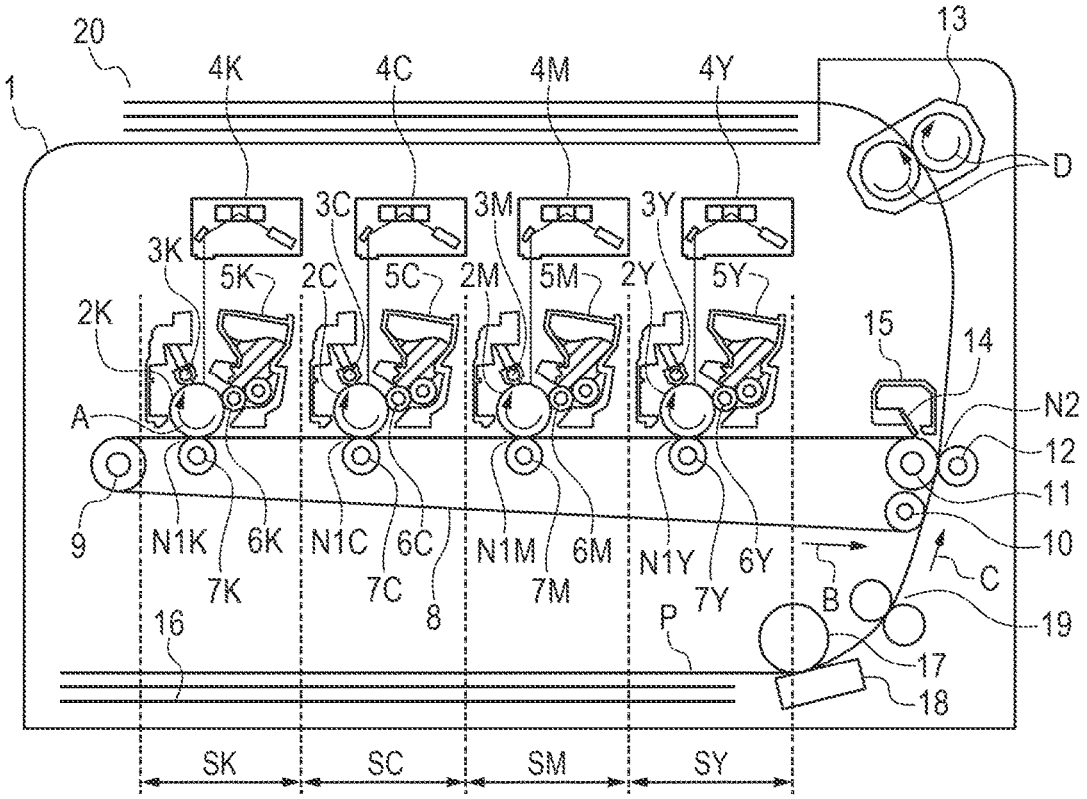
FIGS. 1A and 1B are a schematic cross-sectional view of an image forming apparatus according to Embodiments 1 to 3, and a view for describing a system configuration.

FIG. 1A is a schematic cross-sectional view of an image forming apparatus. An image forming apparatus 1 is a multicolor image forming apparatus that adopts an inkjet method which uses an intermediate transfer belt 8. The intermediate transfer belt 8, which is an endless-belt-shaped intermediate transfer member, is suspended around a drive roller 9, a tension roller 10, and a secondary transfer inner roller 11. The intermediate transfer belt 8 is circularly conveyed in the direction of an arrow B (movement direction) by the drive roller 9 that receives a driving force from a motor (not shown). Image forming units SY, SM, SC, and SK, which form images of the colors yellow (Y), magenta (M), cyan (C) and black (K), respectively, are disposed at fixed intervals in contact with a face on the upward side in the vertical direction of the intermediate transfer belt 8. Note that the configurations and operations of the image forming units SY, SM, SC, and SK of Embodiment 1 are substantially the same as each other except that the colors of the images that the image forming units SY, SM, SC, and SK form are different from each other. Therefore, when no particular distinction is to be made therebetween, description is made by omitting the suffixes Y, M, C, and K attached to the reference characters to indicate which color the relevant component is provided for. A photosensitive drum 2 and a primary transfer roller 7 nip the intermediate transfer belt 8 therebetween to form a primary transfer nip portion N1. Further, a secondary transfer outer roller 12 is pressed toward the secondary transfer inner roller 11 with the intermediate transfer belt 8 interposed therebetween, to thereby form a secondary transfer nip portion N2. At a position that is downstream from the secondary transfer nip portion N2 along the intermediate transfer belt 8, a cleaning portion 14, which is a cleaning unit of the intermediate transfer belt 8, is caused to contact against the intermediate transfer belt 8. Each image forming unit S includes the photosensitive drum 2, which is a photosensitive member; a charge roller 3, which is a charge unit; an exposure device 4, which is an exposure unit; a developing device 5, which is a developing unit; and the primary transfer roller 7, which is a transfer unit, which are disposed around the photosensitive drum 2. The exposure devices 4Y, 4M, 4C, and 4K are disposed with respect to the photosensitive drums 2Y, 2M, 2C, and 2K so as to scan a laser beam (light beam) in the axial direction of the corresponding photosensitive drum 2, respectively. Hereinafter, the axial direction of the photosensitive drum 2 is referred to as the "main-scanning direction". Further, a direction substantially orthogonal to the main-scanning direction is referred to as the "sub-scanning direction". Each exposure device 4 has a light source (not shown) that emits a light beam according to image data and that forms an electrostatic latent image on the photosensitive drum 2 (on the photosensitive member) by scanning a laser beam in the main-scanning direction according to image data.

(Description of Block Diagram of Image Forming Apparatus)

Figure 1B:
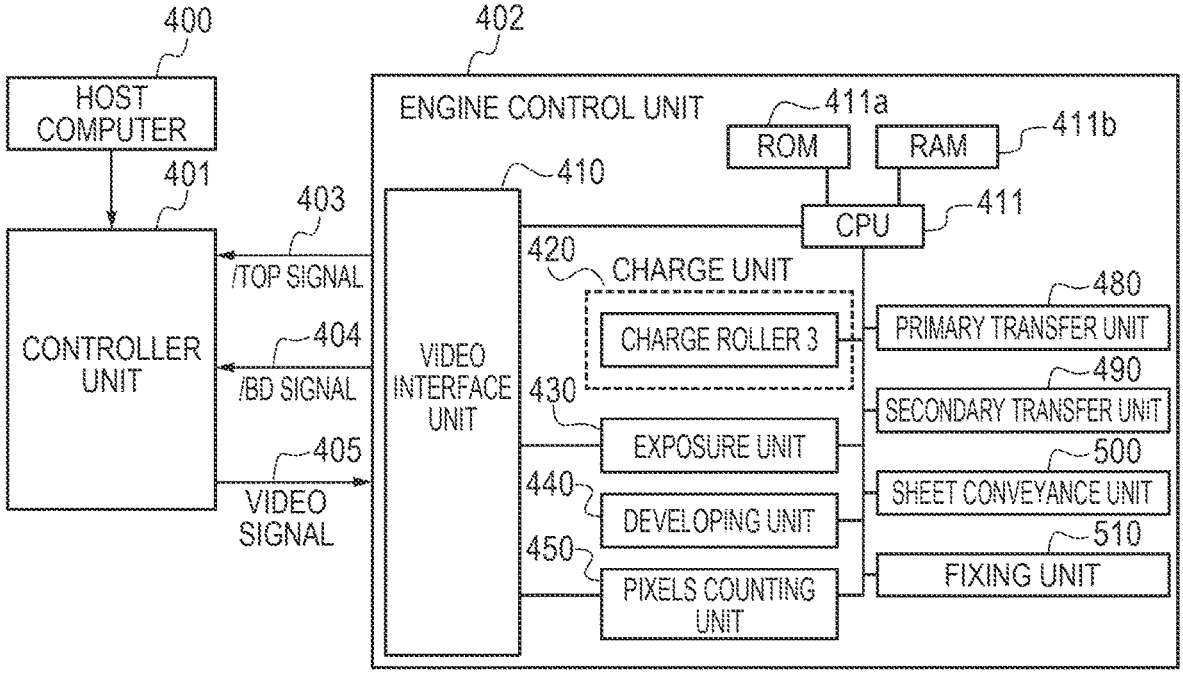

FIG. 1B is a system configuration diagram of the image forming apparatus 1 of Embodiment 1. A controller unit 401 is configured to be capable of communicating bilaterally with a host computer 400 and an engine control unit 402, respectively. Upon receiving image information and a print command from the host computer 400, the controller unit 401 analyzes the received image information and converts the image information to bit data. Then, for each sheet of a recording material P, the controller unit 401 sends (outputs) a print reservation command, a print start command, and a video signal 405 corresponding to the image data to the engine control unit 402 through a video interface unit 410. Information such as the paper type of the recording material P, the paper feeding port, and the size of the recording material P (including the width of the recording material) is specified by the print reservation command. The controller unit 401 sends a print reservation command for notifying the print conditions from the host computer 400 to the engine control unit 402 in the printing order. Further, at a timing at which the image forming apparatus 1 is in a state in which the image forming apparatus 1 is capable of printing, the controller unit 401 sends a print start command to the engine control unit 402.

The engine control unit 402 carries out preparations for performing print operations in the order of the print reservation commands that were received from the controller unit 401, and the engine control unit 402 waits until receiving the print start command that is sent from the controller unit 401. Upon receiving the print start command from the controller unit 401, the engine control unit 402 outputs a /TOP signal 403 and a /BD signal 404 that serve as reference timings for outputting the video signal 405 to the controller unit 401. The engine control unit 402 starts a print operation according to the print reservation command that is received. The /TOP signal 403 is a signal that serves as a reference for the sub-scanning direction when outputting the video signal 405, and the /BD signal 404 is a signal that serves as a reference for the main-scanning direction when outputting the video signal 405. That is, output of the video signal 405 for printing on a new page is started each time the /TOP signal 403 is input. Further, output of the video signal 405 for one line in the main-scanning direction is started each time the /BD signal 404 is input. In the engine control unit 402, a CPU 411, which is a control unit, controls a charge unit 420, an exposure unit 430, a developing unit 440, a primary transfer unit 480, a secondary transfer unit 490, a sheet conveyance unit 500, and a fixing unit 510 to perform image formation processing that is necessary for a print operation. The CPU 411 controls each of the aforementioned units while using a RAM 411*b* as a work area according to various programs that are stored in a ROM 411*a*.

The charge unit 420 controls the charge rollers 3 according to an instruction of the CPU 411. The exposure unit 430 controls the exposure devices 4 according to an instruction of the CPU 411. The developing unit 440 controls the developing devices 5 according to an instruction of the CPU 411. The primary transfer unit 480 controls the primary transfer rollers 7 according to an instruction of the CPU 411. The secondary transfer unit 490 controls the secondary transfer outer roller 12 according to an instruction of the CPU 411. The sheet conveyance unit 500 controls a paper feeding roller 17 and a pair of registration rollers 19 that are described later and the like according to an instruction of the CPU 411. The fixing unit 510 controls a fixing device 13 to be described later according to an instruction of the CPU 411. The details of a pixels counting unit 450 as a measuring unit will be described later.

(Image Forming Operations)

Image forming operations of the image forming apparatus 1 will be described below referring to FIGS. 1A and 1B. When the image forming apparatus 1 starts an image forming operation, the photosensitive drum 2 receives a driving force from a motor (not shown) and rotates in the direction of an arrow A (predetermined rotation direction). A voltage of, for example, −1100 V is applied to the charge roller 3 to charge the surface of the photosensitive drum 2, which has a photoconductive layer, to a predetermined potential and thereby form a uniform background potential of, for example, −500 V on the photosensitive drum 2. Next, the exposure device 4 scans the surface of the photosensitive drum 2 with a laser beam according to a laser drive signal to thereby expose the surface of the photosensitive drum 2 and form an electrostatic latent image (latent image) on the photosensitive drum 2. The surface potential at a portion that received the maximum light amount decreases (absolute value) to, for example, around −100 V. The developing device 5 coats toner charged to a negative polarity as the normal polarity onto a developing roller 6. The developing roller 6 is arranged so as to be capable of contacting against and separating from the photosensitive drum 2, and a voltage of, for example, −300 V is applied thereto. Upon the electrostatic latent image that is formed on the photosensitive drum 2 contacting the developing roller 6 of the developing device 5, toner adheres to (develops) the latent image potential portion by means of an electric field that is formed between the electrostatic latent image of the photosensitive drum 2 and the developing roller 6, and thus the electrostatic latent image on the photosensitive drum 2 becomes a toner image. Toner that is charged to normal polarity (negative polarity) does not adhere to a portion having a background potential other than the electrostatic latent image of the photosensitive drum 2 because an electric field formed at such a portion is opposite to the electric field at the electrostatic latent image portion. A voltage of, for example, +600 V is applied to the primary transfer roller 7. During the course of passing through a respective primary transfer nip portion N1, the toner image formed on the photosensitive drum 2 is transferred (primary transfer) onto the intermediate transfer belt 8 by an electric field formed between the photosensitive drum 2 and the primary transfer roller 7. During the course of the intermediate transfer belt 8 passing in sequence through the primary transfer nip portions N1Y, N1M, N1C, and N1K, the toner images formed at the respective image forming units S are subjected to a primary transfer onto the intermediate transfer belt 8 (onto the intermediate transfer member) in sequential order. Thus, a multicolor toner image in which toner images of a plurality of colors are superimposed is formed on the intermediate transfer belt 8.

Further, accompanying the image forming operation, the paper feeding roller 17 is caused to rotate to pick up one sheet of the recording material P that is in a paper feeding tray 16. The sheets of recording material P are separated into single sheets by friction with a separation pad 18, and the sheet is then conveyed in the direction of an arrow C. Subsequently, the recording material P is caused to stop while a skew of the recording material P is corrected by the pair of registration rollers 19. A voltage of, for example, +1500 V is applied to the secondary transfer outer roller 12. The pair of registration rollers 19 are then caused to rotate at a timing at which the leading edge of the toner image formed on the intermediate transfer belt 8 and the leading edge of the recording material P arrive simultaneously at the secondary transfer nip portion N2, to thereby cause the recording material P to enter the secondary transfer nip portion N2. The toner image formed on the intermediate transfer belt 8 is transferred (secondary transfer) onto the recording material P by means of an electric field between the intermediate transfer belt 8 and the secondary transfer outer roller 12. Thereafter, the recording material P onto which the unfixed toner image has been transferred is conveyed to a fixing device 13. The fixing device 13 that is driven in the direction of an arrow D by a motor (not shown) fixes the unfixed toner image to the recording material P by heating the recording material P while pressurizing the recording material P. The recording material P onto which the toner image has been fixed is then discharged onto a discharge tray 20. Toner that remains on the intermediate transfer belt 8 after the secondary transfer is referred to as "secondary transfer residual toner". The secondary transfer residual toner is recovered by the cleaning portion 14 of the intermediate transfer belt 8. The cleaning portion 14 of the intermediate transfer belt 8 removes secondary transfer residual toner that is on the intermediate transfer belt 8 by, for example, causing the edge of a blade made of rubber that is supported by a metal plate to contact against the intermediate transfer belt 8 to scrape off the toner. The removed toner is recovered in a toner recovery container 15. Note that the configuration of the cleaning portion 14 may be other than the configuration described above.

(Adherence of Toner to Charge Roller)

When a toner image that is formed on the intermediate transfer belt 8 by an image forming unit S (for example, the image forming unit SY) that is located upstream in the movement direction of the intermediate transfer belt 8 passes through a primary transfer nip portion N1 located downstream thereof (for example, at the image forming unit SK), the following phenomenon occurs. That is, the polarity of toner that is charged upon receiving an electric discharge that occurs due to a large difference in potential between the background potential portion of the photosensitive drum 2 and the primary transfer roller 7 becomes a polarity that is the reverse to the normal polarity (for example, becomes a positive polarity; hereunder, such toner is referred to as "toner charged in an opposite pole"), and such toner adheres to a downstream photosensitive drum 2. Toner that adheres to a photosensitive drum 2 in this way is referred to as "retransferred toner". A voltage of, for example, −1100 V is applied to the charge roller 3 during image forming to attract the retransferred toner charged in an opposite pole. Therefore, the distribution in the main-scanning direction of the amount of toner that adheres to the charge roller 3 (hereinafter, referred to as "toner adherence amount") exhibits the following correlation. That is, the toner image that passed through the primary transfer nip portion N1 correlates with the distribution in the main-scanning direction of the area of pixels to be printed (hereunder, also referred to as "pixel area"; proportional to the number of pixels (hereunder, referred to as "pixels count")). Thus, the larger that the pixels count of the pixels to be printed is, the larger that the toner adherence amount of retransferred toner to the charge roller 3 becomes.

In Embodiment 1, the toner adherence amount of retransferred toner (hereunder, also referred to as "retransferred toner amount") of a 100% yellow image formed by the image forming unit SY located on the upstream side that was measured at the image forming unit SK was substantially 1.0%. The method of measuring the retransferred toner is as follows. The retransferred toner adhering to the photosensitive drum 2 after the toner image passes through the primary transfer nip portion N1 is collected using a polyester tape, and the polyester tape is attached onto fine quality paper. Further, as a reference, polyester tape in its original state (tape on which retransferred toner is not collected) is attached onto the fine quality paper side by side with the aforementioned polyester tape. These two polyester tapes are then, for example, passed through a complementary color filter for the toner color and measured using a reflection densitometer TC-6DS manufactured by Tokyo Denshoku Co. Ltd. A difference between the two measurement results is taken as the retransferred toner amount. In addition, a 100% yellow image having a belt shape extending in the sub-scanning direction was consecutively printed on A4-sized recording materials P, and changes in the image density due to retransferred toner adhering to the charge roller 3 at that time were organoleptically evaluated. In the case of forming a uniform image in the main-scanning direction, fluctuations in density could be recognized from the 100th page, while in the case of an image having a distribution in the main-scanning direction as in the case of the aforementioned belt-shaped image, fluctuations in density could be recognized from the 30th page.

(Charge Roller Cleaning Operation)

Hereunder, a charge roller cleaning operation, which is a removing process that removes adhered toner from the charge roller 3, will be described. When toner adheres to the charge roller 3, the charging capability of the charge roller 3 changes, and therefore in some cases there is a risk that the charge roller 3 will not be able to uniformly charge the photosensitive drum 2. Consequently, there is a problem that fluctuations in the image density occur. Therefore, a charge roller cleaning operation is performed that expels the toner adhering to the charge roller 3. First, the photosensitive drum 2 and the developing roller 6 are separated so that new toner does not adhere to the photosensitive drum 2. The image forming apparatus 1 has a charge voltage application portion (not shown), which is a voltage application unit, that applies a voltage to the charge roller 3. The voltage applied to the charge roller 3 by the charge voltage application portion is −1100 V, which is the same as at a time of image formation, and the surface of the photosensitive drum 2 is charged to −500 V. Next, the voltage applied to the primary transfer roller 7 is switched to 0 V. The difference in potential between the photosensitive drum 2, whose surface is charged to −500 V, and the primary transfer nip portion N1 does not exceed the electric discharge threshold. Therefore, an electric discharge does not occur between the photosensitive drum 2 and the primary transfer nip portion N1, and the surface potential of the photosensitive drum 2 immediately prior to passing next through a nip portion with the charge roller 3 is maintained at −500 V.

The voltage applied to the charge roller 3 is then switched to 0 V. An electric field between the charge roller 3 and the photosensitive drum 2 is in the opposite direction to the direction at a time of image formation, and therefore toner charged in an opposite pole (for example, toner having positive polarity) adhering to the charge roller 3 is ejected to the photosensitive drum 2. Thereafter, the voltage applied to the primary transfer roller 7 is switched to −1000 V. At the primary transfer nip portion N1, the toner charged in an opposite pole on the photosensitive drum 2 receives a force that directs the toner charged in an opposite pole from the photosensitive drum 2 toward the intermediate transfer belt 8, thereby undergoing primary transfer onto the intermediate transfer belt 8. The toner charged in an opposite pole on the intermediate transfer belt 8 is conveyed together with the intermediate transfer belt 8, and arrives at the secondary transfer nip portion N2. A voltage of +300 V is applied to the secondary transfer outer roller 12, and the toner charged in an opposite pole is thus caused to pass through the secondary transfer nip portion N2 in a state in which the toner charged in an opposite pole remains on the intermediate transfer belt 8. Subsequently, the toner charged in an opposite pole on the intermediate transfer belt 8 is removed from the intermediate transfer belt 8 by the cleaning portion 14 of the intermediate transfer belt 8, and is recovered by the toner recovery container 15.

By the above described operations, the charge roller 3 enters a state in which toner charged in an opposite pole does not adhere thereto, and thus the charging capability of the charge roller 3 is restored. In Embodiment 1, it is assumed that a charge roller cleaning operation is always performed during various processes (hereunder, referred to as "post rotation sequence") that are executed after image formation when a print job is completed.

(Determination as to Whether to Perform Charge Roller Cleaning Operation During Print Job)

A determination as to whether to perform a charge roller cleaning operation during a print job is made based on the value of a pixels count for each area that is defined when an area on the photosensitive drum 2 is divided into a plurality of areas in the main-scanning direction. In Embodiment 1, the distribution in the main-scanning direction of a toner adherence amount on the charge roller 3 is predicted based on the pixels count for each area.

When a print job is started, the pixels counting unit 450 (FIG. 1B), which is a measuring unit, counts a pixels count of pixels that are exposed on the photosensitive drums 2 for each color by counting light-emission signals with respect to a laser of the exposure devices 4. In other words, the pixels counting unit 450 counts the pixels count of pixels to be printed, based on the video signal 405 corresponding to image data that is input from the controller unit 401. The term "pixels to be printed" refers to pixels corresponding to areas onto which a laser was emitted and a latent image was formed on the photosensitive drum 2 and to which toner adheres. In order to count the pixels count in each area defined when the area on the photosensitive drum 2 is divided into a plurality of areas in the main-scanning direction, the pixels counting unit 450 counts the pixels count based on the following values. Note that with respect to the /BD signal 404, for example, the phrase "the /BD signal 404 is output" is used to describe a situation in which the signal transitioned from high level to low level.

L: distance to the center position in the main-scanning direction of the image from a position when the /BD signal 404 is output [dots].

B: distance in the main-scanning direction in which the pixels count is counted [dots].

A: distance from a position when the /BD signal 404 is output until counting of the pixels count is started [dots].

$$A=L-(B/2) \quad \text{equation (1)}$$

n: maximum number into which an area can be divided into a plurality of areas in the main-scanning direction (hereunder, referred to as "maximum division number").

C: width in the main-scanning direction of each area [dots].

$$C=B/n \quad \text{equation (2)}$$

(Conventional Dividing Method)

Figure 2:
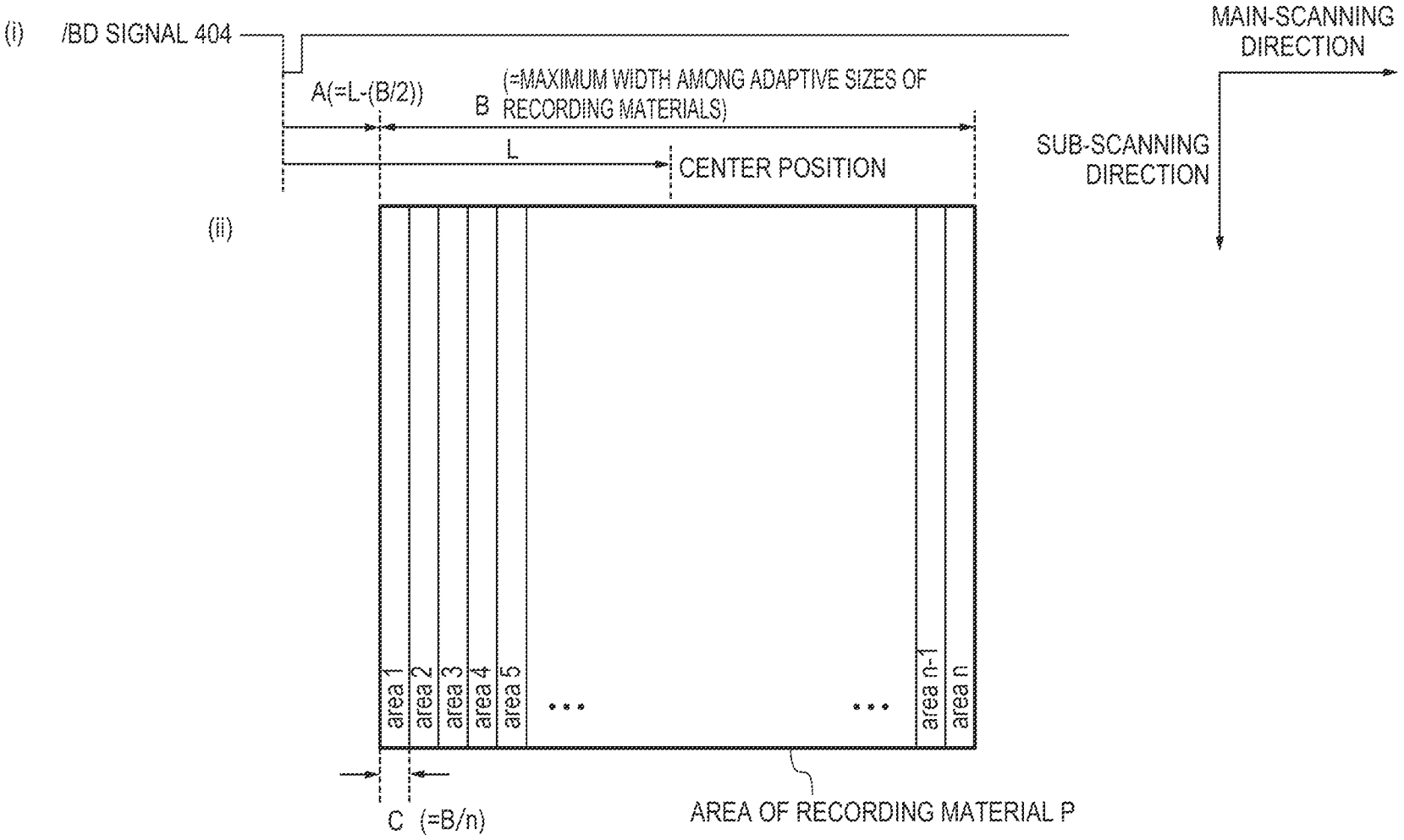
FIG. 2 is a view for describing processing at a conventional pixels counting unit, for the purpose of comparison with Embodiment 1.

FIG. 2 is a view for describing a conventional method for dividing areas, in which (i) illustrates a waveform of the /BD signal 404. In FIG. 2, (ii) illustrates the area of the recording material P in the main-scanning direction and the sub-scanning direction, and is assumed to correspond to the area on the photosensitive drum 2. In FIG. 2, area 1 to area n, which are defined by dividing the area of the recording material P, are denoted as area 1, area 2, . . . , area n−1, area n. Each area n is an elongated strip-like area extending in the sub-scanning direction of an image for one page that is to be printed on the recording material P, and for each area n the pixels counts for one page are summed and counted. Conventionally, as illustrated in FIG. 2, the maximum width (the term "width" refers to the length in the main-scanning direction) among adaptive sizes of the recording materials P supported by the image forming apparatus 1 is always set for the distance B. Here, it is assumed that in the image forming apparatus 1, for example, the resolution is 600 dpi and the maximum width among adaptive sizes of the recording materials P supported is 215.9 mm (=5120 dots) (letter size). In this image forming apparatus 1, in a case where the maximum division number n is 1024, based on equation (2), the width C of each area is 5 dots (=5120/1024).

The pixels counting unit 450 counts a pixels count in each area from area 1 to area 1024 during a print job. The CPU 411, which is a prediction unit, predicts the toner adherence amount of the charge roller 3 based on the pixels count that was measured by the pixels counting unit 450. In a case where the predicted toner adherence amount is equal to or greater than a threshold value of any area (at least one area), the CPU 411, which is also a determination unit, determines that a large amount of toner is accumulated on the charge roller 3 at the relevant area. The CPU 411 interrupts the print job partway through execution of the print job to perform a charge roller cleaning operation. That is, the CPU 411 interrupts the print job to execute a charge roller cleaning operation. In Embodiment 1, as a threshold value that is used to determine whether or not to execute a charge roller cleaning operation, a value of a pixels count such that, for example, in a case where there is a vertical line of a solid image in each area, the threshold value is reached when 30 pages are consecutively printed, is set. Because toner adhering to the charge roller 3 is removed when a charge roller cleaning operation is performed, the occurrence of ghost images in the subsequent image forming operations can be prevented. By performing a charge roller cleaning operation according to a pixels count in this way, the charge roller cleaning operation can be performed at a timing at which toner has accumulated on the charge roller. Therefore, in comparison to a case where a charge roller cleaning operation is performed at intervals of a predetermined number of pages, the occurrence of ghost images can be suppressed while also reducing a decrease in throughput. However, in the case of performing a charge roller cleaning operation by the method illustrated in FIG. 2, the following problem arises.

In this case, the smaller that the value of the width C of each area is, the more accurately the pixels counting unit 450 can predict the distribution in the main-scanning direction of the toner adherence amount on the charge roller 3. However, the smaller that the value of the width C of each area is made, that is, the larger that the value of the maximum division number n is made, the greater the processing speed and memory capacity that are required to count the pixels counts for the respective areas, which leads to an increase in costs. In some cases, as the result of suppressing an increase in costs, the value of the width C of each area becomes greater than the width of a visually observable ghost image. A problem in such a case is that errors sometimes occur with respect to the correlation between the pixels counts for the respective areas and the toner adherence amount on the charge roller 3, and consequently a charge roller cleaning operation is performed earlier than the actual optimal timing.

Figure 3:
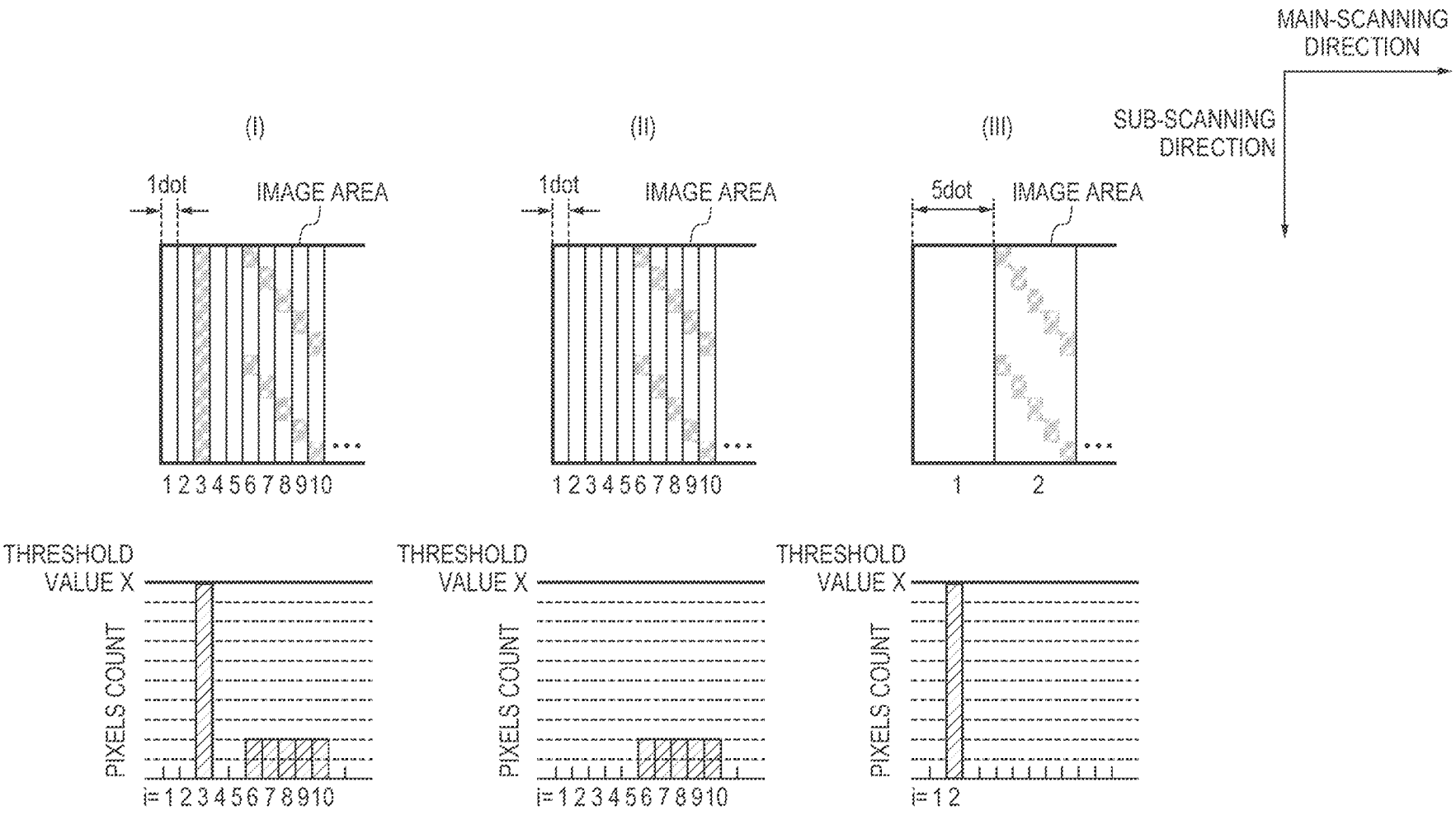
FIG. 3 is a view for describing processing at a conventional pixels counting unit, for the purpose of comparison with Embodiment 1.

FIG. 3 will now be used to describe an error with respect to the correlation between predicted pixels counts of each area and the actual toner adherence amount on the charge roller 3. In FIG. 3, (I), (II), and (III) illustrate states when image forming operations are performed on the same number of pages. In the diagrams on the upper side in FIG. 3, an image area, the width C of each area, and area 1, . . . , area 10, . . . and the like are shown, with pixels at which a toner image is formed being shown in grey. In the diagrams on the lower side in FIG. 3, the pixels count of each area that was counted by the pixels counting unit 450 is shown, and a threshold value (for example, X pixels) for determining whether or not to execute a charge roller cleaning operation is indicated by a thick line. In the diagrams on the lower side in FIG. 3, the character "i" is a symbol that represents the sequential order of the areas (for example, 1 to 10).

In FIG. 3, (I) and (II) illustrate cases where the value of the width C of each area is one dot. In (I), there is an image of a vertical line that is a continuous image in the sub-scanning direction in area 3, and when consecutive printing is performed, the toner amount distribution in the main-scanning direction on the charge roller 3 is greatest in area 3 (pixels count X). In (II), because the image of a vertical line that is in area 3 in (I) is not present (pixels count is 0), the timing at which the pixels count reaches the threshold value is later than in the case illustrated in (I). In FIG. 3, (III) illustrates a case where the value of the width C of each area is five dots. That is, in comparison to (I) and (II), (III) is a case where the arithmetic processing speed and the memory capacity is kept lower to suppress an increase in costs. Comparing (II) and (III), even though the toner distributions in the main-scanning direction on the charge roller 3 are the same, the timing at which the pixels count reaches the threshold value in (III) is earlier than in (II). This is because, in the case illustrated in (III), a distinction cannot be made between the vertical line (image in area 3 in (I)) that is at a predetermined position in the main-scanning direction and the image (image in area 2 in (III)) that is distributed in a dispersed manner in the main-scanning direction. Specifically, in the case illustrated in (III), even though the image in area 2 is distributed in a dispersed manner in the main-scanning direction, the value of the pixels count is equal to the threshold value X.

With regard to this problem, in Embodiment 1 the width of the recording material P which is being subjected to the print job is set as the value of the distance B, and not the maximum width among adaptive sizes of the recording materials P supported by the image forming apparatus 1. By this means, particularly in a case where the width of the recording material P is small, the value of the width C of each area is made smaller than in the conventional method, and errors in the pixels counts that are counted are reduced.

(Division Method of Embodiment 1)

Figure 4:
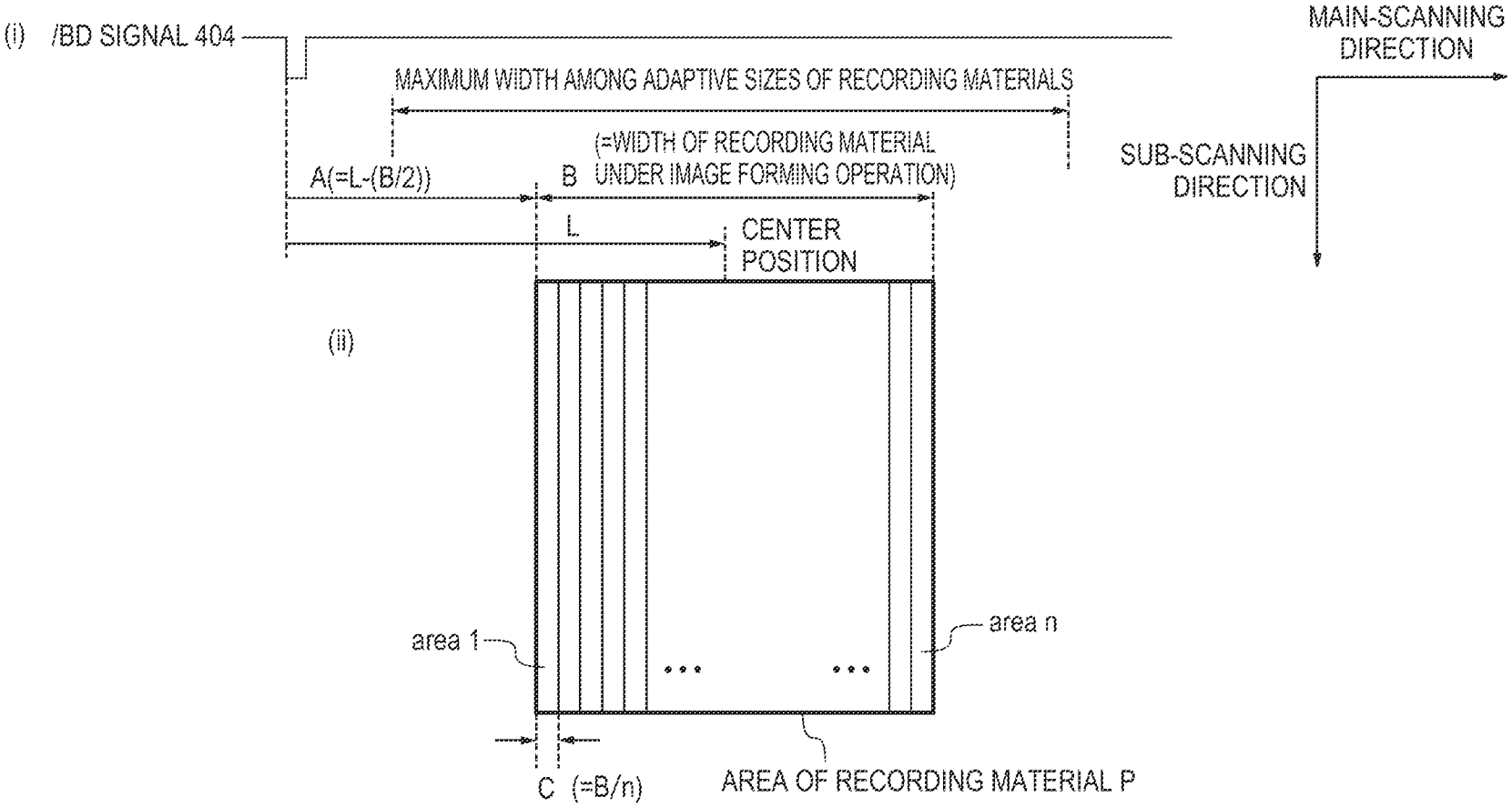
FIG. 4 is a view for describing processing at a pixels counting unit of Embodiment 1.

FIG. 4 is a view for describing a method for dividing areas according to Embodiment 1, in which (i) illustrates a waveform of the /BD signal 404. In FIG. 4, (ii) is a view illustrating areas for which the video signal 405 is output in the main-scanning direction and sub-scanning direction, and shows areas that correspond to an image to be formed on the recording material P, and also corresponds to the area on the photosensitive drum 2. As illustrated in FIG. 4, when a print job is started, the CPU 411 acquires the width in the main-scanning direction of the recording material P for each page from the controller unit 401, and sets the width as the distance B. In Embodiment 1, the distance B is the width of the recording material P that is the object on which the current image forming operation is being performed (hereunder, referred to as "relevant page"). In a case where the width in the main-scanning direction of the recording material P is, for example, 148.0 mm (=3496 dots) (A5 size), and the maximum division number n=1024, based on equation (2) the width C of each area is 3.4 dots (=3496/1024). The distance A is calculated by equation (1). Thus, the width C of each area can be made smaller than in the conventional example (five dots), and the toner adherence amount on the charge roller 3 can be accurately predicted.

Figure 5:
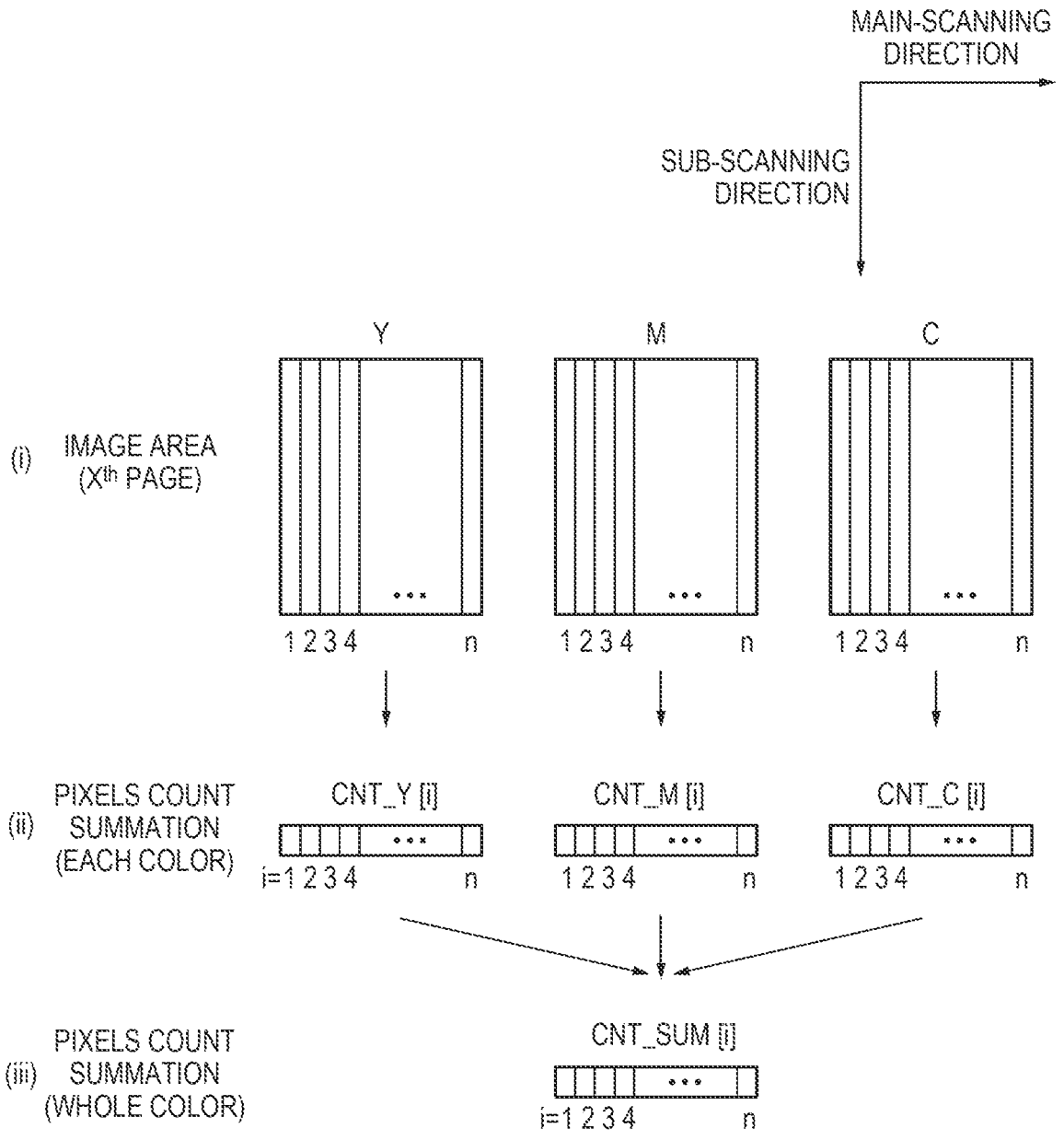
FIG. 5 is a view for describing processing at a pixels counting unit of Embodiment 1.

FIG. 5 is a view that illustrates the process of data processing when determining whether to execute a charge roller cleaning operation. FIG. 5 (i) illustrates image areas (area 1 to area n) for each of the colors Y, M, and C for an $X^{th}$ page. When output of the video signals 405 for each color of the relevant page is completed, the CPU 411 acquires a pixels count for the respective areas of Y, M, and C from the pixels counting unit 450. The CPU 411 adds the acquired pixels counts to summed values of the pixels counts for each area acquired with respect to the recording materials P that were printed after the previous charge roller cleaning operation ended. For area 1 to area n, the summed pixels counts are represented by CNT_Y[i], CNT_M[i], and CNT_C[i] (i=1 to n). FIG. 5 (ii) illustrates pixels counts CNT_Y[i], CNT_M[i], and CNT_C[i] (i=1 to n) that were acquired in the image areas (area 1 to area n) of each of the colors Y, M, and C for an $X^{th}$ page. These values correspond to the toner amounts that passed through the primary transfer nip portions N1Y, N1M, and N1C, respectively, and correlate with retransferred toner amounts that arise at the downstream primary transfer nip portions N1. Retransferred toner adheres to the charge rollers 3 of the downstream image forming units S. For example, a toner image formed on the intermediate transfer belt 8 by the image forming unit SY adheres to the charge rollers 3M, 3C, and 3K of the image forming unit SM, SC, and SK that are downstream from the image forming unit SY. However, an image of the image forming unit SK, which is the image forming unit which is located furthest downstream among the four image forming units S, does not contribute to retransferring. Therefore, counting of the pixels count is not performed at the image forming unit (SK) that is located furthest downstream.

Next, the CPU 411 performs processing for whole colors. The CPU 411 sums the pixels counts for all colors using the following equation.

$$CNT_SUM[i]=CNT_Y[i]+CNT_M[i]+CNT_C[i](i=1 \text{ to } n) \quad \text{equation (3)}$$

FIG. 5 (iii) shows a CNT_SUM[i] obtained by summing the pixels counts CNT_Y[i], CNT_M[i], and CNT_C[i] (i=1 to n) for each color in the image areas (area 1 to area n) of the $X^{th}$ page. The value of the pixels count CNT_SUM[i] obtained by summing the pixels counts of whole colors corresponds to the integrated amount of toner adhering to the charge roller 3 of K at which the amount of retransferred toner is largest.

(Threshold Value Determination Processing)

Lastly, threshold value determination processing is performed. The CPU 411 determines whether or not the threshold value is exceeded in any area i of the pixels count CNT_SUM[i] obtained by summing the pixels counts for whole colors. In a case where the pixels count CNT_SUM[i] exceeds the threshold value in any (at least one) area i, the CPU 411 temporarily interrupts the image forming operation to perform a charge roller cleaning operation. The CPU 411 resets all of the pixels counts (CNT_Y[i], CNT_M[i], CNT_C[i], CNT_SUM[i]) after the charge roller cleaning operation is completed.

Further, as mentioned above, because the width of the recording material P in the print job that is being performed is set as the value of the distance B, in a case where the width of the recording material P is switched during a print job, the width C(=B/n) of each area that is counted at the pixels counting unit 450 changes. Consequently, if the aforementioned processing is performed as it is, it may not be possible to accurately predict the adherence amount of toner on the charge roller 3. Therefore, in Embodiment 1, it is assumed that in a case where the width of the recording material P is changed during a print job, the CPU 411 always performs a charge roller cleaning operation and resets the pixels counts.

(Processing for Determining Whether to Perform Charge Roller Cleaning Operation)

Figure 6:
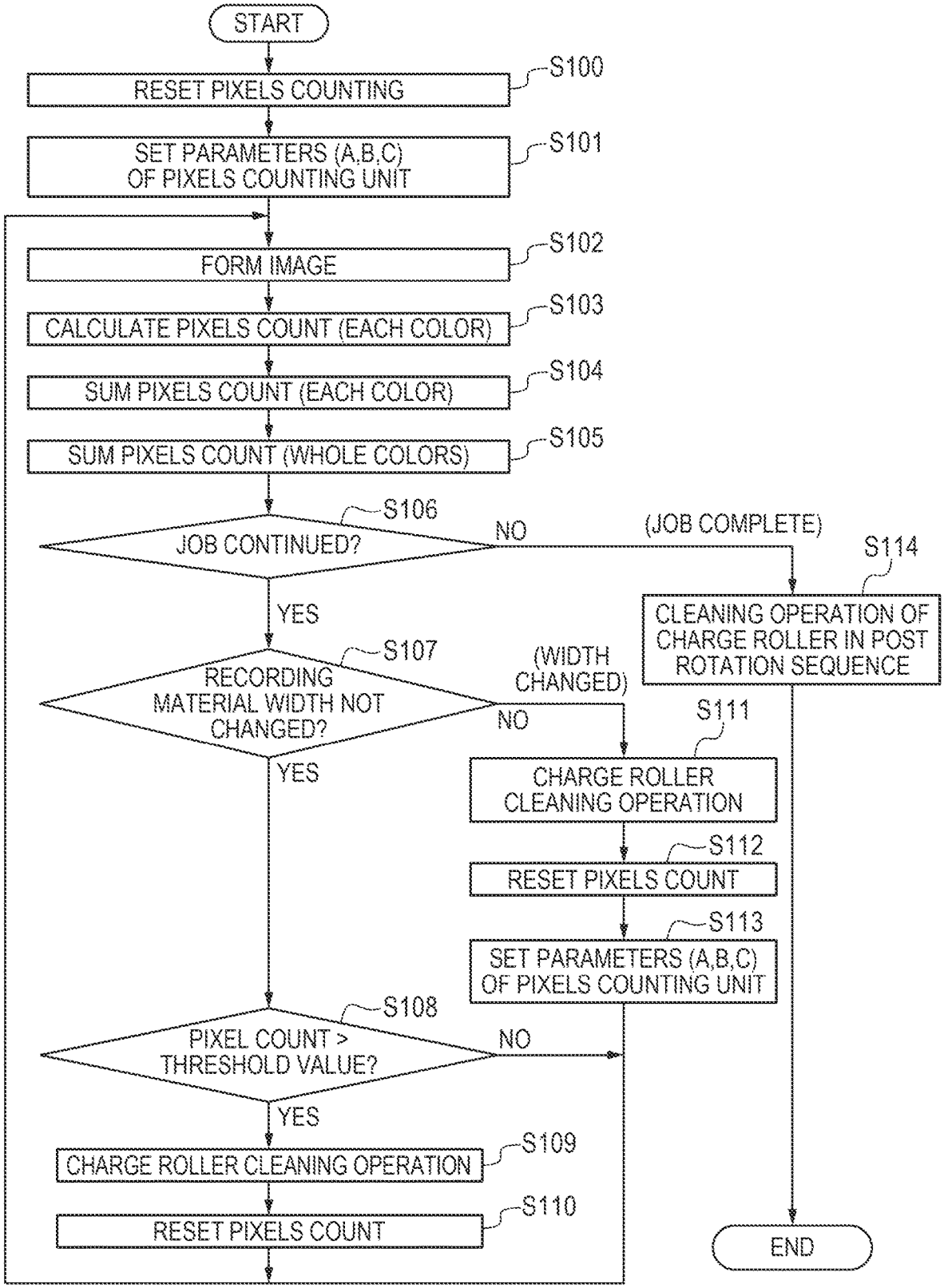
FIG. 6 is a flowchart illustrating processing for determining whether to perform a charge roller cleaning operation of Embodiment 1.

The processing for determining whether to perform a charge roller cleaning operation of Embodiment 1 is described below using the flowchart shown in FIG. 6. In operation S100, upon receiving an image formation instruction from the controller unit 401, the CPU 411 performs operations for image formation preparation (hereunder, also referred to as "pre-rotation sequence"). The CPU 411 resets the pixels counts (CNT_Y[i], CNT_M[i], CNT_C[i], CNT_SUM[i]).

In S101, the CPU 411 sets parameters (distance A, distance B, width C of each area) for performing pixel counting by the pixels counting unit 450 in the RAM 411*b*. Specifically, the CPU 411 acquires the width in the main-scanning direction of the specified recording material P from the controller unit 401, and the CPU 411 sets the width as the value of the distance B. The CPU 411 calculates the distance A using equation (1) based on the value of the distance B, calculates the width C of each area using equation (2), and sets the calculated values in the RAM 411*b*. In S102, the CPU 411 performs an image forming operation on the relevant page.

In S103, when the output of the video signal 405 for each color of the relevant page ends, the CPU 411 acquires the pixels count of each area i of Y, M, and C (each color) from the pixels counting unit 450. In S104, for each color, the CPU 411 sums the pixels counts acquired in S103, respectively (CNT_Y[i], CNT_M[i], CNT_C[i]) (FIG. 5(*ii*)). In S105, the CPU 411 sums the pixels counts of each color that were summed in S104 for whole colors (CNT_SUM[i]=CNT_Y[i]+CNT_M[i]+CNT_C[i]) (FIG. 5 (iii)).

In S106, the CPU 411 checks reservation information (print reservation command) that is sent from the controller unit 401, and the CPU 411 determines whether or not to continue the print job (image forming operation). If the CPU 411 determines in S106 that the image forming operation is to be continued, the CPU 411 acquires the size of the following recording material P from the print reservation command and advances the processing to S107. If the CPU 411 determines in S106 that the image forming operation is not to be continued (the job has ended), the CPU 411 advances the processing to S114. In S107, the CPU 411 determines whether or not the width in the main-scanning direction of the recording material P (hereunder, referred to as "following page") on which image formation is to be performed following the relevant page is different from the width of the previous recording material P (relevant page). In other words, the CPU 411 determines whether or not the width of the recording material P has not changed. In a case where the CPU 411 determines in S107 that there is no change in the width of the recording material P, that is, that the width in the main-scanning direction of the following page is the same as the width of the previous recording material P (relevant page), the CPU 411 advances the processing to S108.

In S108, the CPU 411 determines whether or not any value among the pixels counts CNT_SUM[1] to CNT_SUM[n] for whole colors that were summed in S105 exceeds the threshold value in any area. If the CPU 411 determines in S108 that any value among the pixels counts CNT_SUM[1] to CNT_SUM[n] exceeds the threshold value in any area, the CPU 411 advances the processing to S109. In S109, the CPU 411 temporarily interrupts the image forming operation and performs a charge roller cleaning operation. In S110, after the charge roller cleaning operation ends, the CPU 411 resets the pixels counts (CNT_Y[i], CNT_M[i], CNT_C[i], CNT_SUM[i]). If the CPU 411 determines in S108 that the pixels counts CNT_SUM[1] to CNT_SUM[n] do not exceed the threshold value in any area, the CPU 411 returns the processing to S102 without performing a charge roller cleaning operation and continues the image forming operation.

In a case where the CPU 411 determines in S107 that there is a change in the width of the recording material P, that is, the CPU 411 determines that the width in the main-scanning direction of the following page is different from the width of the previous recording material P (relevant page) (case where there is a change), the CPU 411 advances the processing to S111. In S111, the CPU 411 performs a charge roller cleaning operation, and in S112 the CPU 411 resets the pixels counts (CNT_Y[i], CNT_M[i], CNT_C[i], CNT_SUM[i]). In S113, the CPU 411 sets, in the RAM 411*b*, the distance A, the distance B, and the value of the width C of each area as parameters to be used for pixel counting by the pixels counting unit 450 according to the width in the main-scanning direction of the following page. The CPU 411 then returns the processing to S102 and continues the image forming operation.

If the CPU 411 determines in S106 that the image forming operation is not to be continued, the CPU 411 advances the processing to S114. In S114, the CPU 411 carries out a post rotation sequence for ending the image forming operation, performs a charge roller cleaning operation, and ends the image forming operation.

Thus, according to Embodiment 1, by changing the width of an area for pixel counting according to the width of the recording material P being used in the print job, an error in the correlation between a pixels count and a toner adherence amount on the charge rollers 3 can be reduced, particularly in a case where the width of the recording material P is small. Thus, a timing at which to perform a charge roller cleaning operation can be made the optimal timing, and the occurrence of decreases in the throughput can be suppressed.

Thus, according to Embodiment 1, even in a case where there is a limitation with regard to the width of each area in which a pixels count is to be counted in order to suppress an increase in costs, a decrease in throughput that is caused by cleaning operations on the charge rollers can be suppressed.

Embodiment 2

In Embodiment 1, the width of an area for pixel counting is changed according to the width of the recording material P that is undergoing the print job. Further, in Embodiment 1, a technique is described which, in a case where the width of the recording material P is switched during the print job, performs a charge roller cleaning operation and resets the pixels counts (No in S107, and S111 to S113 in FIG. 6). In Embodiment 2, a technique is described which, in a case where the width of the recording material P is switched during a print job, continues to use the pixels counts and does not reset the pixels counts. A description of the principal portions such as the configuration of the image forming apparatus 1 is the same as in Embodiment 1, and the same reference characters are assigned to the same components, and only portions that are different from Embodiment 1 will be described hereunder.

(Data Processing of Pixels Counts when Width of Recording Material P is Switched)

Figure 7:
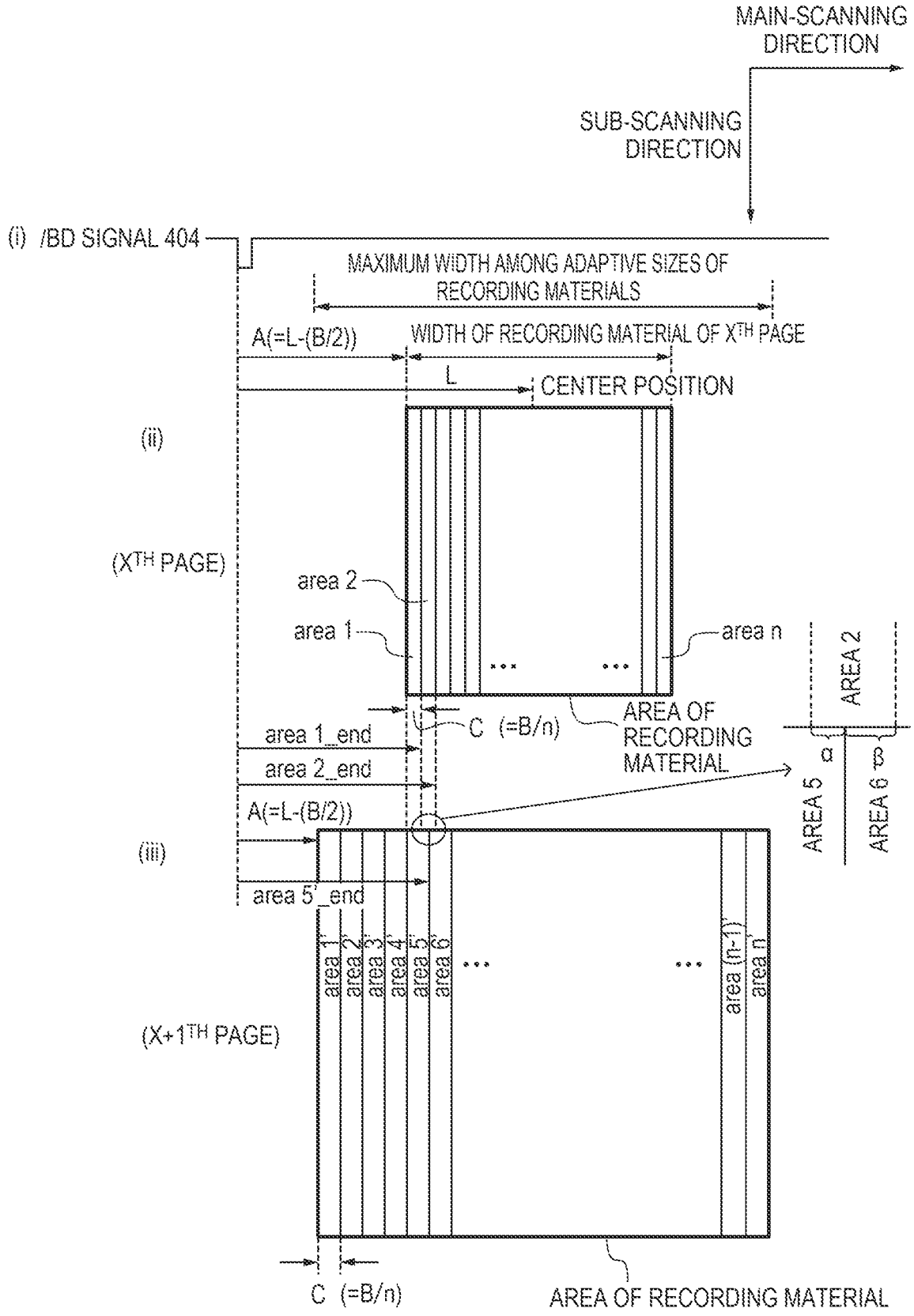
FIG. 7 is a view for describing processing at a pixels counting unit of Embodiment 2.

Data processing of pixels counts when the width of the recording material P is switched during a print job is described below using FIG. 7. In FIG. 7, a situation is illustrated in which, with respect to a change in the width from an $X^{th}$ page to an $X+1^{th}$ page, the width in the main-scanning direction of the recording material P is switched from a small width to a large width during a print job. FIG. 7(*i*) illustrates a waveform of the /BD signal 404. FIG. 7(*ii*) illustrates the area of the recording material P in the main-scanning direction and sub-scanning direction with respect to the $X^{th}$ page. FIG. 7(*iii*) illustrates the area of the recording material P with respect to the $X+1^{th}$ page in which the width in the main-scanning direction is greater than in the $X^{th}$ page. Further, to distinguish area 1 to area n of the $X+1^{th}$ page from area 1 to area n of the $X^{th}$ page, area 1 to area n of the $X+1^{th}$ page are denoted as area 1' to area n'. Further, "i'" is used as a symbol that indicates the sequential order of the areas of the $X+1^{th}$ page.

In the example in FIG. 7, with respect to the position in the main-scanning direction of the photosensitive drum 2, area 1 of the $X^{th}$ page is included in area 5 of the $X+1^{th}$ page. Therefore, the CPU 411 transfers the pixels count CNT_SUM[1] for area 1 of the $X^{th}$ page to a pixels count CNT_SUM[5] for area 5 of the $X+1^{th}$ page.

Area 2 of the $X^{th}$ page straddles area 5 and area 6 of the $X+1^{th}$ page. In such a case, according to Embodiment 2 the pixels count CNT_SUM[2] is proportionally distributed among the pixels counts CNT_SUM[5] and CNT_SUM[6] according to the distance of each straddling area. In a case where one area of the relevant page before the width of the recording material P is switched corresponds to a plurality of areas of the following page after the width is switched, the pixels count CNT_SUM[2] is distributed as follows. That is, a toner adherence amount that was measured in one area of the relevant page is proportionally distributed according to the respective distances in the main-scanning direction that the one area occupies in a plurality of areas of the following page. In a case where the pixels count for area 2 of the $X^{th}$ page is represented by "T", the distance that is straddled in area 5 of the $X+1^{th}$ page is represented by "α", and the distance that is straddled in area 6 of the $X+1^{th}$ page is represented by "β" (see FIG. 7), proportional distribution of the pixels count T is performed using the equations below.

Here, a distance from a time that the /BD signal 404 is output until the end of area 1 of the $X^{th}$ page is represented by "area1_end". A distance from a time that the /BD signal 404 is output until the end of area 2 of the $X^{th}$ page is represented by "area2_end". A distance from a time that the /BD signal 404 is output until the end of area 5 of the $X+1^{th}$ page is represented by "area5'_end".

α=area5' end-area1_end.

β=area2_end-area5'_end.

The pixels count allocated to area 5 of the $X+1^{th}$ page=T×α(α+β).

The pixels count allocated to area 6 of the $X+1^{th}$ page=T×β(α+β).

(Processing to Determine Whether to Perform Charge Roller Cleaning Operation)

Figure 8:
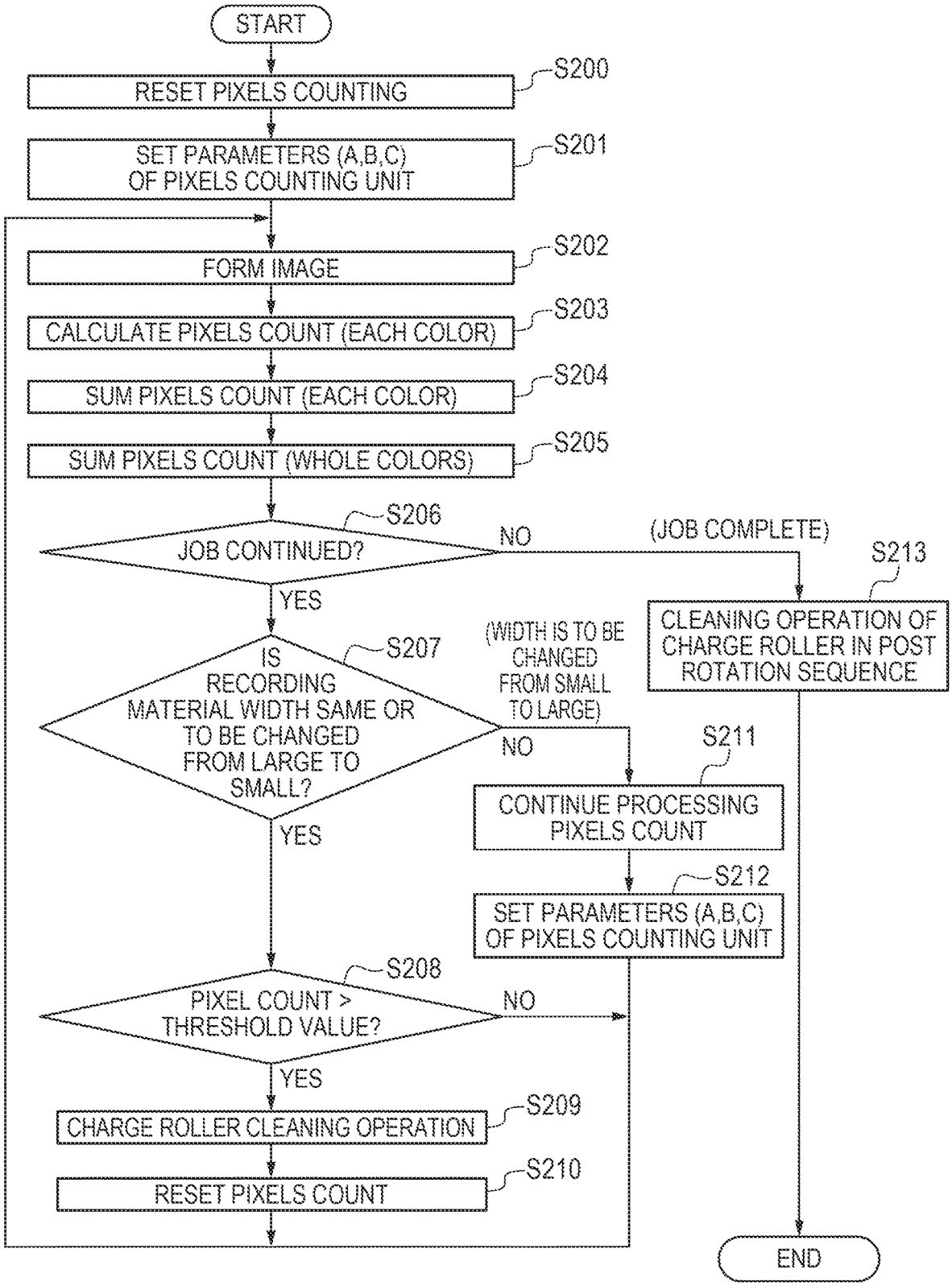
FIG. 8 is a flowchart illustrating processing for determining whether to perform a charge roller cleaning operation of Embodiment 2.

Processing to determine whether to perform a charge roller cleaning operation according to Embodiment 2 is described below using the flowchart in FIG. 8. Note that since the processing in S200 to S206, S208 to S210, S212 and S213 in FIG. 8 is the same as the processing in S100 to S106, S108 to S110, S113 and S114 that was described in relation to FIG. 6, a description of that processing is omitted here.

In S206, in a case where the CPU 411 determines that an image forming operation is to be continued, the CPU 411 advances the processing to S207. In S207, the CPU 411 determines whether or not the width in the main-scanning direction of the following page is the same as the width of the previous recording material P (relevant page), and whether or not the width in the main-scanning direction of the following page is smaller than the width of the previous recording material P (relevant page). If the CPU 411 determines in S207 that the width in the main-scanning direction of the following page is the same as the width of the previous recording material P (relevant page), or that the width in the main-scanning direction of the following page is smaller than the width of the previous recording material P (relevant page), the CPU 411 advances the processing to S208.

If the CPU 411 determines in S207 that the width in the main-scanning direction of the following page is greater than the width of the previous recording material P (relevant page) (there is a change from smaller to larger), the CPU 411 advances the processing to S211. In S211, the CPU 411 performs continuation processing with respect to the pixels counts. Here, the phrase "continuation processing with respect to the pixels counts" refers to processing that, as described using FIG. 7, adapts the pixels count of each area i of the $X^{th}$ page to the pixels count of each area i' of the $X+1^{th}$ page. In a case where area i of the $X^{th}$ page is included in area i' of the $X+1^{th}$ page, the CPU 411 transfers the pixels count CNT_SUM[i] for area i of the $X^{th}$ page to the pixels count CNT_SUM[i'] for area i' of the $X+1^{th}$ page. In a case where the area i of the $X^{th}$ page straddles area i' and area i+1' of the $X+1^{th}$ page, the CPU 411 performs a proportional distribution, as described above. That is, the CPU 411 proportionally distributes the pixels count CNT_SUM[i] for area i of the $X^{th}$ page between the pixels count CNT_SUM [i'] for area i' of the $X+1^{th}$ page and the pixels count CNT_SUM[i+1'] for area i+1' of the $X+1^{th}$ page. By proportionally distributing the pixels count CNT_SUM[i] that was summed in S205, the CPU 411 continues to use the pixels counts from prior to switching of the recording material P. That is, in a case where the width of the recording material P is changed from a smaller width to a larger width, the CPU 411 does not execute a charge roller cleaning operation.

Thus, according to Embodiment 2, by changing the width of an area for pixel counting according to the width of the recording material P being used in the print job, an error in the correlation between a pixels count and a toner adherence amount on the charge rollers 3 can be reduced, particularly in a case where the width of the recording material P is small. Further, even in a case where the width of the recording material P is switched during a print job, since in some cases a charge roller cleaning operation is not performed, a decrease in the throughput when the width of the recording material P is switched can also be suppressed.

Thus, according to Embodiment 2, even in a case where there is a limitation with regard to the width of each area in which a pixels count is to be counted in order to suppress an increase in costs, a decrease in throughput caused by cleaning operations on the charge rollers can be suppressed.

Embodiment 3

In Embodiments 1 and 2, techniques were described which change the width of an area in which to perform pixel counting according to the width of the recording material P being used in the print job. In Embodiment 3, a technique is described which changes the width of an area in which to perform pixel counting according to the image area of an image to be formed on the recording material P (on the recording material). A description of the principal portions, such as the configuration, is the same as in Embodiments 1 and 2, and only portions that are different from Embodiments 1 and 2 will be described hereunder.

(Pixels Counting Unit)

Figure 9:
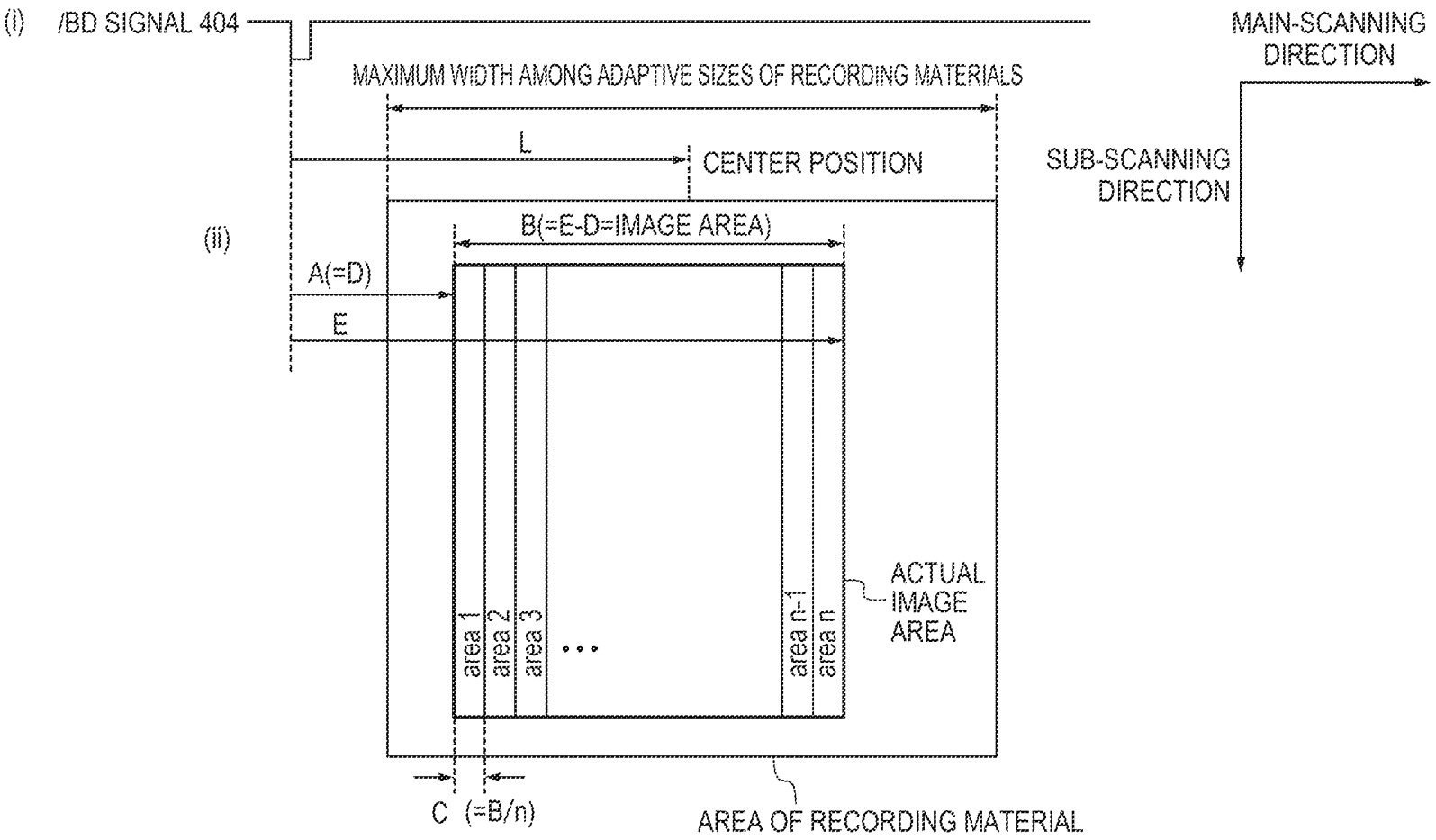
FIG. 9 is a view for describing processing at a pixels counting unit of Embodiment 3.

The pixels counting unit 450 of Embodiment 3 will be described using FIG. 9. FIG. 9(*i*) and (ii) are similar to the diagrams in FIG. 2. FIG. 9(*ii*) is a diagram that illustrates the area of the recording material P, and an image area that is to be actually printed on the recording material P. In Embodiment 3, for each page, the CPU 411 acquires the positions of both ends of the actual image from the controller unit 401, and decides the values of A, B, and C of the pixels counting unit 450.

First, the controller unit 401 analyzes image information for the relevant page and sends distance information regarding distances from a time that the /BD signal 404 is output to both ends of the image to the engine control unit 402 prior to the print start command. The distance as far as an end on the upstream side in the main-scanning direction in the image area is taken as "D" (=A), and the distance as far as an end on the downstream side in the main-scanning direction is taken as "E". Next, the CPU 411 sets the values of the parameters A, B, and C for the pixels counting unit 450 based on the aforementioned items of information.

$$A=D \quad \text{equation (4)}$$

$$B=E-D \quad \text{equation (5)}$$

The distances A and B are calculated by equation (4) and equation (5), and the width C of each area is calculated using the aforementioned equation (2). According to this technique, when the width in the main-scanning direction of the actual image is less than the width of the recording material P, the value of C for each area can be reduced without being limited to the width of the recording material P.

(Processing to Determine Whether to Perform Charge Roller Cleaning Operation)

Figure 10:
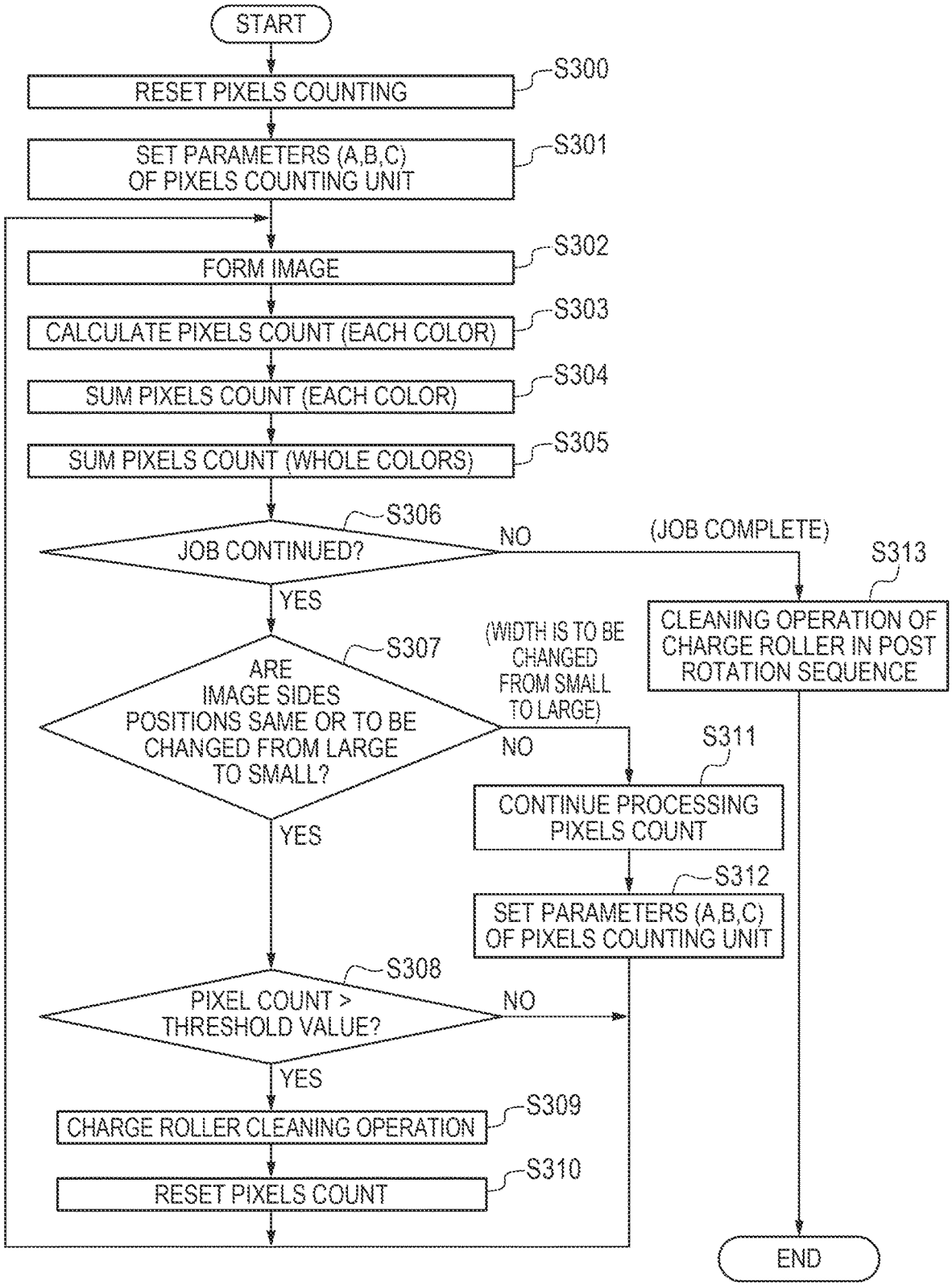
FIG. 10 is a flowchart illustrating processing for determining whether to perform a charge roller cleaning operation of Embodiment 3.

Processing to determine whether to perform a charge roller cleaning operation according to Embodiment 3 is described below using the flowchart in FIG. 10. Note that since the processing in S300, S302 to S306, S308 to S310, S311 and S313 is the same as the processing in S200, S202 to S206, S208 to S210, S211 and S213 that was described in relation to FIG. 8, a description of that processing is omitted here.

In S301, the CPU 411 acquires positional information regarding both ends of the actual image from the controller unit 401 (distances D and E in FIG. 9). The CPU 411 determines the distance A, the distance B, and the value of the width C of each area, which are parameters for performing pixel counting by the pixels counting unit 450, by means of equation (4), equation (5), and equation (2), respectively. In S306, if the CPU 411 determines that the image forming operation is to be continued, the CPU 411 advances the processing to S307. In S307, the CPU 411 determines whether or not the positional information for both ends of the image of the following page is the same as the positional information for both ends of the image of the relevant page, and the CPU 411 determines whether or not the positional information for both ends of the image of the following page indicates a smaller image than the positional information for both ends of the image of the relevant page. If the CPU 411 determines in S307 that the positional information for both ends of the image of the following page is the same as the positional information for both ends of the image of the relevant page or that the positional information for both ends of the image of the following page indicates a smaller image than the positional information for both ends of the image of the relevant page, the CPU 411 advances the processing to S308. If the CPU 411 determines in S307 that the positional information for both ends of the image of the following page indicates a larger image than the positional information for both ends of the image of the relevant page (there is a change from smaller to larger), the CPU 411 advances the processing to S311. In S312, the CPU 411 determines the distance A, the distance B, and the value of the width C of each area that are parameters for performing pixel counting by the pixels counting unit 450 based on the positional information for both ends of the image of the following page, by means of equation (4), equation (5), and equation (2), respectively.

The operations of Embodiment 3 may be used in a case where the same image is printed consecutively (printing of multiple copies, or copy printing or the like). In such a case, in S301, the CPU 411 receives a command indicating whether or not the same image is to be consecutively printed from the controller unit 401, and the CPU 411 determines whether or not to execute the processing of Embodiment 3. In a case where the CPU 411 determines that the same image is to be consecutively printed, the CPU 411 determines the width C of each area based on positional information for both ends of the image. Further, the processing of Embodiment 3 that determines the distance A, the distance B, and the width C of each area as parameters, based on positional information for both ends of the image, may also be applied to FIG. 6 of Embodiment 1. That is, a configuration may be adopted in which the width C of each area is determined based on positional information for both ends of the image, and a charge roller cleaning operation is always performed in a case where the positional information for both ends of the image changes between the relevant page and the following page.

Thus, according to Embodiment 3, the width of an area for pixel counting is changed according to information regarding both ends of the image that is acquired from the controller unit 401. By this means, when the width of the actual image area is smaller than the maximum width among adaptive sizes of the recording materials P supported by the image forming apparatus, errors with respect to the correlation between pixels counts and toner adherence amounts on the charge rollers 3 can be reduced. Therefore, a decrease in throughput due to a charge roller cleaning operation can be suppressed.

Thus, according to Embodiment 3, even in a case where there is a limitation with respect to the width of each area in which a pixels count is to be counted in order to suppress an increase in costs, a decrease in throughput caused by cleaning operations on the charge rollers can be suppressed.

According to various embodiments, even in a case where there is a limitation with respect to the width of each area in which a pixels count is to be counted in order to suppress an increase in costs, a decrease in throughput caused by cleaning operations on the charge rollers can be suppressed.

While the present disclosure has described exemplary embodiments, it is to be understood that some embodiments are not limited to the disclosed exemplary embodiments. The scope of the following claims is to be accorded the broadest interpretation so as to encompass all such modifications and equivalent structures and functions.

This application claims priority to Japanese Patent Application No. 2018-147445, which was filed on Aug. 6, 2018 and which is hereby incorporated by reference herein in its entirety.

What is claimed is:

1. An image forming apparatus for performing image formation on a recording material, the image forming apparatus comprising:

a photosensitive member configured to rotate in a predetermined rotation direction;

a charge unit configured to charge a surface of the photosensitive member to a predetermined potential;

an exposure unit including a light source configured to emit a light beam according to image data, the exposure unit configured to form a latent image on the photosensitive member by scanning the light beam in a scanning direction substantially orthogonal to the rotation direction;

a developing unit configured to develop the latent image formed by the exposure unit by toner to form a toner image;

an intermediate transfer member onto which the toner image formed on the photosensitive member by the developing unit is to be transferred;

a transfer unit configured to transfer the toner image onto the intermediate transfer member;

a measuring unit configured to measure a pixels count of pixels forming the toner image based on the image data; and a determination unit configured to make a determination as to whether or not to perform a removing process that removes toner from the charge unit, based on the pixels count of pixels measured by the measuring unit, wherein based on a width that is a length in the scanning direction of a recording material on which the image formation is performed, the measuring unit divides an area in the scanning direction of the recording material into a plurality of areas according to a predetermined number of divisions, and measures the pixels count for each area of the plurality of areas into which the area in the scanning direction of the recording material is divided.

2. An image forming apparatus according to claim 1, wherein a width of each area of the plurality of areas defined by dividing the area in the scanning direction of the recording material decreases to decrease of the width that is the length in the scanning direction of the recording material on which the image formation is performed.

3. An image forming apparatus according to claim 1, wherein the measuring unit sums pixels counts for one page of the image data with respect to each area of the plurality of areas.

4. An image forming apparatus according to claim 1, comprising:

an image forming unit including the photosensitive member, the charge unit, the developing unit and the transfer unit; and a plurality of the image forming units, wherein the measuring unit does not perform measurement of the pixels count with respect to one image forming unit provided furthest downstream in a movement direction of the intermediate transfer member among the plurality of image forming units, and wherein the prediction unit predicts the amount of toner based on a pixels count obtained by summing pixels counts measured for each of the plurality of image forming units.

5. An image forming apparatus according to claim 1, wherein in a case where the width is switched during a print job, the determination unit determines that the removing process is performed.

6. An image forming apparatus according to claim 1, wherein in a case where the width is switched during a print job that is a case where the width becomes larger than the width before switching, the determination unit determines not to perform the removing process, and wherein the measuring unit continues measurement of the pixels counts.

7. An image forming apparatus according to claim 6, wherein in a case where the measuring unit continues measurement of the pixels counts that is a case where one area of a predetermined page prior to the width being switched corresponds to a plurality of areas of a following page after the width is switched, the measuring unit proportionally distributes a pixels count measured in the one area of the predetermined page according to distances in the scanning direction which the one area occupies in the plurality of areas of the following page.

8. An image forming apparatus according to claim 1, wherein in a case where the determination unit determines that image formation ended, the determination unit determines that the removing process is performed in processing after the image formation ends.

9. An image forming apparatus according to claim 1, wherein in a case where the amount of toner predicted by the prediction unit exceeds a predetermined amount in at least one area among the plurality of areas, the determination unit determines that the removing process is performed.

10. An image forming apparatus according to claim 1, comprising:

a voltage application unit configured to apply a voltage to the charge unit, and a cleaning unit configured to remove toner on the intermediate transfer member;

wherein in a case where the removing process is performed, the voltage application unit applies a voltage to the charge unit to move toner adhering to the charge unit to the photosensitive member, the transfer unit transfers toner moved onto the photosensitive member to the intermediate transfer member, and the cleaning unit removes toner transferred onto the intermediate transfer member.

11. An image forming apparatus configured to perform image formation on a recording material, the image forming apparatus comprising:

a photosensitive member configured to rotate in a predetermined rotation direction;

a charge unit configured to charge a surface of the photosensitive member to a predetermined potential;

an exposure unit including a light source configured to emit a light beam according to image data, the exposure unit being configured to form a latent image on the photosensitive member by scanning the light beam in a scanning direction substantially orthogonal to the rotation direction;

a developing unit configured to develop the latent image formed by the exposure unit by toner to form a toner image;

an intermediate transfer member onto which the toner image formed on the photosensitive member by the developing unit is to be transferred;

a transfer unit configured to transfer the toner image onto the intermediate transfer member;

a measuring unit configured to measure a pixels count of pixels forming the toner image based on the image data; and a determination unit configured to make a determination as to whether or not to perform a removing process that removes toner from the charge unit, based on the pixels count of pixels measured by the measuring unit;

wherein based on a width that is a length in the scanning direction of an image to be formed on a recording material on which image formation is performed, the measuring unit divides an area in the scanning direction of the image into a plurality of areas according to a predetermined number of divisions, and measures the pixels count for each area of the plurality of areas into which the area in the scanning direction of the image is divided.

12. An image forming apparatus according to claim 11, comprising a controller unit configured to output the image data, wherein the controller unit determines positions of both ends of the image based on the image data for each page, and wherein the measuring unit divides the area in the scanning direction of the image into the plurality of areas based on the positions of both ends of the image that are determined by the controller unit.

13. An image forming apparatus according to claim 12, wherein in a case of consecutively printing a same image on a plurality of recording materials, the measuring unit divides the area in the scanning direction of the image into the plurality of areas based on positions of both ends of the image.

14. An image forming apparatus according to claim 11, wherein a width of each area of the plurality of areas defined by dividing the area in the scanning direction of the recording material decreases to decrease the width that is the length in the scanning direction of the recording material on which the image formation is performed.

15. An image forming apparatus according to claim 11, wherein the measuring unit sums pixels counts for one page of the image data with respect to each area of the plurality of areas.

16. An image forming apparatus according to claim 11, comprising:

an image forming unit including the photosensitive member, the charge unit, the developing unit and the transfer unit; and a plurality of the image forming units, wherein the measuring unit does not perform measurement of the pixels count with respect to one image forming unit provided furthest downstream in a movement direction of the intermediate transfer member among the plurality of image forming units, and wherein the prediction unit predicts the amount of toner based on a pixels count obtained by summing pixels counts measured for each of the plurality of image forming units.

17. An image forming apparatus according to claim 11, wherein in a case where the width is switched during a print job, the determination unit determines that the removing process is performed.

18. An image forming apparatus according to claim 11, wherein in a case where the width is switched during a print job that is a case where the width becomes larger than the width before switching, the determination unit determines not to perform the removing process, and wherein the measuring unit continues measurement of the pixels counts.

19. An image forming apparatus according to claim 18, wherein in a case where the measuring unit continues measurement of the pixels counts that is a case where one area of a predetermined page prior to the width being switched corresponds to a plurality of areas of a following page after the width is switched, the measuring unit proportionally distributes a pixels count measured in the one area of the predetermined page according to distances in the scanning direction which the one area occupies in the plurality of areas of the following page.

20. An image forming apparatus according to claim 11, wherein in a case where the determination unit determines that image formation ended, the determination unit determines that the removing process is to be performed in processing after the image formation ends.

21. An image forming apparatus according to claim 11, wherein in a case where the amount of toner predicted by the prediction unit exceeds a predetermined amount in at least one area among the plurality of areas, the determination unit determines that the removing process is to be performed.

22. An image forming apparatus according to claim 11, comprising:

a voltage application unit configured to apply a voltage to the charge unit, and a cleaning unit configured to remove toner on the intermediate transfer member, wherein when the removing process is performed, the voltage application unit applies a voltage to the charge unit to move toner adhering to the charge unit to the photosensitive member, the transfer unit transfers toner moved onto the photosensitive member to the intermediate transfer member, and the cleaning unit removes toner transferred onto the intermediate transfer member.

* * * * *